United States Patent [19]

Ferguson et al.

[11] Patent Number: 4,582,044

[45] Date of Patent: Apr. 15, 1986

[54] CLEAN BURNING EXTERIOR RETROFIT SYSTEM FOR SOLID FUEL HEATING APPLIANCES

[75] Inventors: Robert W. Ferguson, South Royalton; Derik K. Andors; William W. Crossman, Jr., both of Randolph, all of Vt.

[73] Assignee: Vermont Castings, Inc., Randolph, Vt.

[21] Appl. No.: 572,000

[22] Filed: Jan. 19, 1984

[51] Int. Cl.[4] ..... F23L 3/00

[52] U.S. Cl. ..... 126/289; 126/77; 126/83; 110/211; 110/214; 422/180

[58] Field of Search ..... 126/58, 60, 61, 62, 126/63, 65, 66, 67, 69, 74, 75, 77, 83, 285 R, 289, 292; 431/7, 328; 110/211, 214, 254, 203; 122/40; 422/177, 180

[56] References Cited

U.S. PATENT DOCUMENTS

| | | | |
|---|---|---|---|
| 2,845,882 | 8/1958 | Bratton . | |
| 3,056,467 | 10/1962 | Ravich | 23/277 |
| 3,880,594 | 4/1975 | Shaw | 23/277 C |
| 4,039,292 | 8/1977 | Morini et al. | 126/19 R X |
| 4,138,220 | 2/1979 | Davies et al. | 422/173 |
| 4,319,556 | 3/1982 | Schwartz et al. | 126/77 |
| 4,330,503 | 5/1982 | Allaire et al. | 422/177 |
| 4,332,206 | 6/1982 | Tucker et al. | 110/203 |
| 4,363,785 | 12/1982 | Willson | 422/173 |
| 4,373,507 | 2/1983 | Schwartz et al. | 422/177 X |
| 4,380,228 | 4/1983 | Crowley | 126/76 |
| 4,400,356 | 8/1983 | McVay et al. | 126/58 X |
| 4,425,305 | 1/1984 | Retallick | 110/211 X |
| 4,437,451 | 3/1984 | Wysong | 126/77 |
| 4,466,421 | 8/1984 | Dorsch et al. | 126/285 A |
| 4,476,852 | 10/1984 | Lee et al. | 126/289 |

FOREIGN PATENT DOCUMENTS

| | | | |
|---|---|---|---|
| 0037281 | 10/1981 | European Pat. Off. | 110/211 |
| 0087259 | 8/1983 | European Pat. Off. | 110/211 |
| 2257072 | 6/1974 | Fed. Rep. of Germany | 422/177 |

OTHER PUBLICATIONS

Mother Earth News, Jan./Feb. 1983, pp. 163–165.
Uni-Com Brochure.
Intensifire Owners Manual.
Smoke Master Brochure.
Smoke Genie Brochure.
Versagrid Brochure.

*Primary Examiner*—Margaret A. Focarino
*Attorney, Agent, or Firm*—Kenway & Jenney

[57] ABSTRACT

Exterior retrofit system for attachment to wood or coal-burning stoves including a secondary combustion chamber and a catalytic igniter. The secondary combustion chamber is lined with refractory material and is arranged to preheat flue gases emanating from the woodburning apparatus before ignition at the catalytic igniter. The refractory walls have an undulating structure to increase mixing and residence times for more complete burning. Provisions are made for introducing additional combustion air into the secondary combustion chamber. Combustion performance is improved resulting in reduction of cresote deposits and particulate emissions and reduction in the amount of fuel consumed for a given heat output. The retrofit unit is self-contained and requires no permanent or complicated modification to the stove. This system also has application for use on the interior of a stove, both as a retrofit and as the basis for a specifically designed stove. The resulting improvement in combustion performance would equal or exceed that of the exterior application.

7 Claims, 2 Drawing Figures

CLEAN BURNING EXTERIOR RETROFIT SYSTEM FOR SOLID FUEL HEATING APPLIANCES

BACKGROUND OF THE INVENTION

As woodburning stoves have become more prevalent, their effects on air pollution have increased. Clean air statutes directed at woodburning stoves have been enacted in a number of areas. Consumers are more aware of the problems associated with burning wood. Typical woodburning stoves emit relatively large amounts of smoke and particulates into the atmosphere and significant creosote deposits can build up on stove pipes and chimneys.

In an effort to make a cleaner burning stove, manufacturers have produced stoves employing various techniques such as secondary combustion chambers and catalytic converters. In addition to stoves specifically designed to be cleaner burning, retrofit units for existing stoves have been introduced to reduce the levels of smoke and cresote. Generally, the operation of known retrofit units is unpredictable at best, depending upon the base appliance on which it is installed. This marginal situation is the result of the retrofit converter being located too far from the wood stove firebox, causing the exhaust gases entering the catalyst of such a retrofit device to be at temperatures too low for optimum catalyst performance especially at lower heat outputs. Furthermore, known retrofit appliances do not provide for a preheat of the combustion gases exiting the woodburning stove before encountering the catalyst. During low heat output operation with known systems, the gases exiting the stove body are often at too low a temperature for sustained catalytic ignition. In such a situation, the catalytic converter can have little if any effect on the levels of undesirable effluents.

It is an object of this invention, therefore, to provide an exterior retrofit system for substantially improving combustion efficiency in solid fuel heating appliances.

Another object of the invention is a retrofit system which substantially reduces smoke output and cresote deposits.

A further object of the invention is an exterior retrofit system which is self-contained and requires no permanent or complicated modifications to the solid fuel heating apparatus.

Yet another object of the invention is a retrofit system which reduces emissions over a wide range of heat outputs and specifically at low heat output levels.

A still further object of this invention is a retrofit unit employing a catalyst having a replacement cost of one half to one third the cost of the catalyst of known catalytic devices.

SUMMARY OF THE INVENTION

The above and other objects of the invention are achieved with an external retrofit combustion system for attachment to a wood burning heating appliance including a firebox attached to the woodburning heating apparatus in communication with the flue gases from the heating appliance. The firebox includes refractory-lined walls separated by a heat exchange barrier creating first and second passageways. A perforate catalytic igniter located at the lower end of the heat exchange barrier provides communication between the first and second passageways. The refractory-lined walls create a secondary combustion chamber for burning the effluents from the stove body thereby resulting in a cleaner burning operation. It is preferred that the heat exchange barrier have a zig-zag configuration and be made of stainless steel. It is also preferred that the refractory-lined walls have an undulating configuration to increase residence time and mixing within the secondary combustion chamber for more complete burning. Means are provided to cause additional air to be introduced into the combustion zone both before and after the catalytic igniter to insure an adequate supply of oxygen for complete combustion. The refractory walls are made of low density formed refractory material. The catalytic igniter is approximately one half to two thirds the thickness of other known catalysts to minimize the pressure drop across the igniter and to reduce replacement costs for the igniter.

BRIEF DESCRIPTION OF THE DRAWING

The invention disclosed herein will be understood more completely with reference to the drawing of which.

DESCRIPTION OF THE PREFERRED EMBODIMENT

Figure 1:
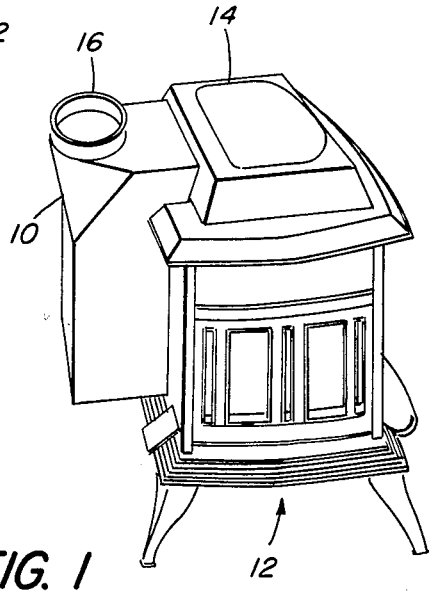
FIG. 1 is a perspective view of the retrofit apparatus disclosed herein attached to a solid fuel heating appliance.

With reference first to FIG. 1, an external retrofit apparatus 10 is shown affixed to a solid fuel heating appliance 12, such as a Vigilant ® wood stove manufactured by Vermont Castings, Inc. The exterior retrofit apparatus 10 includes an attachment portion 14 which is adapted to be bolted directly onto the stove 12 in place of the stove's original flue collar (not shown). A flue collar 16 is then bolted onto the exterior retrofit apparatus 10. The height of the flue collar 16 remains the same as it had been on the wood stove 12 and horizontal and vertical flue position options are retained. In general, the only modifications necessary for the installation of the retrofit unit 10 is repositioning the stove 12 forward approximately 6 inches. The retrofit unit 10 is approximately 14 inches wide, 6½ inches deep and 18 inches high. It is preferred that the external components of the unit 10 be made of cast iron or cast iron in combination with sheet metal or aluminum.

The retrofit unit 10 will now be described in detail with reference to FIG. 2. The retrofit unit 10 is attached to the woodburning stove 12 so that exhaust gases from the stove 12 enter the exterior retrofit apparatus 10 as indicated by the arrow 20. The retrofit apparatus 10 is divided front to back by a stainless steel heat exchanger 22 forming a first passageway 24 and a second passageway 26. As shown, the heat exchanger 22 has a zig-zag or undulating shape to increase surface area for better heat exchange. The walls of the retrofit apparatus 10 are lined with refractory material 28 which also has an undulating shape to increase the effective combustion chamber length and therefore the residence time of the gases. The refractory material 28 is preferably vacuum formed insulating refractory material. The undulating shape of the refractory material 28 also improves mixing for more efficient operation. Openings 29 are provided to allow secondary air to enter the retrofit unit 10 both before and after a catalytic igniter 30. The catalytic igniter 30 is disposed in the lower portion of the retrofit apparatus 10. The catalyst 30 is made of a honeycomb ceramic substrate coated with a catalyst such as platinum. Other catalysts and substrates may also be appropriate. The catalytic igniter 30 is approximately one inch thick. The relative thiness of the catalytic igniter 30 minimizes the pressure drop across the igniter 30.

The operation of the retrofit apparatus 10 will now be discussed. Products of combustion from the wood stove 12 enter the retrofit apparatus 10 along the arrow 20 and flow downwardly through the first passageway 24 and subsequently through the perforate catalytic igniter 30 into the passageway 26. As the gases pass through the catalytic igniter 30, they are ignited and burn further in the secondary combustion area indicated by the bracket 32. Secondary combustion air enters the unit 10 through the openings 29 to provide an adequate supply of oxygen for complete combustion. The catalytic converter 30 is an igniter with a substantial portion of the combustion occurring outside the confines of the catalyst itself. All other known catalytic retrofits for stoves depend upon all combustion occurring within the catalyst volume. The products of the secondary combustion travel upwardly through the passageway 26 and exit through a flue collar 34. As the gases travel upwardly in the passageway 26, they pass across the heat exchanger panel 22 transferring heat into the passageway 24 since the gases in the passageway 26 are substantially hotter than those in the first passageway 24 which have not yet been secondarily burned.

The internal heat exchange capability is an important aspect of this invention. For example, during low heat output operation of the wood stove 12, exhaust gases exiting from the wood stove 12 are often in the temperature range of 350° F.–500° F. which may be too low for catalytic ignition by the catalytic igniter 30. By means of heat transfer through the heat exchange panel 22, these gases are preheated to a temperature of 500° F.–650° F. or higher which is sufficient for sustaining catalytic ignition and subsequent secondary combustion in the retrofit apparatus 10. Also, a cleaner burn will result at higher heat outputs even when the temperature of the gases entering the catalytic igniter is already high enough for catalytic ignition. By always transferring sensible heat to the gas stream entering the catalytic igniter/insulated secondary chamber from the relatively hotter final exhaust, the highest possible temperatures are maintained in the secondary combustion area 32 for more nearly complete burning of the gases. A result of the use of the retrofit apparatus 10 is higher stack temperatures at low heat output than would be the case with a typical non-catalytic stove burning at a comparable pound per hour rate of fuel consumption. The resulting higher stack temperatures of the retrofit apparatus 10 at low heat output can help prevent condensation within the stovepipe or chimney and also improve low draft problems in installations having marginal draft and/or during warmer weather.

Figure 2:
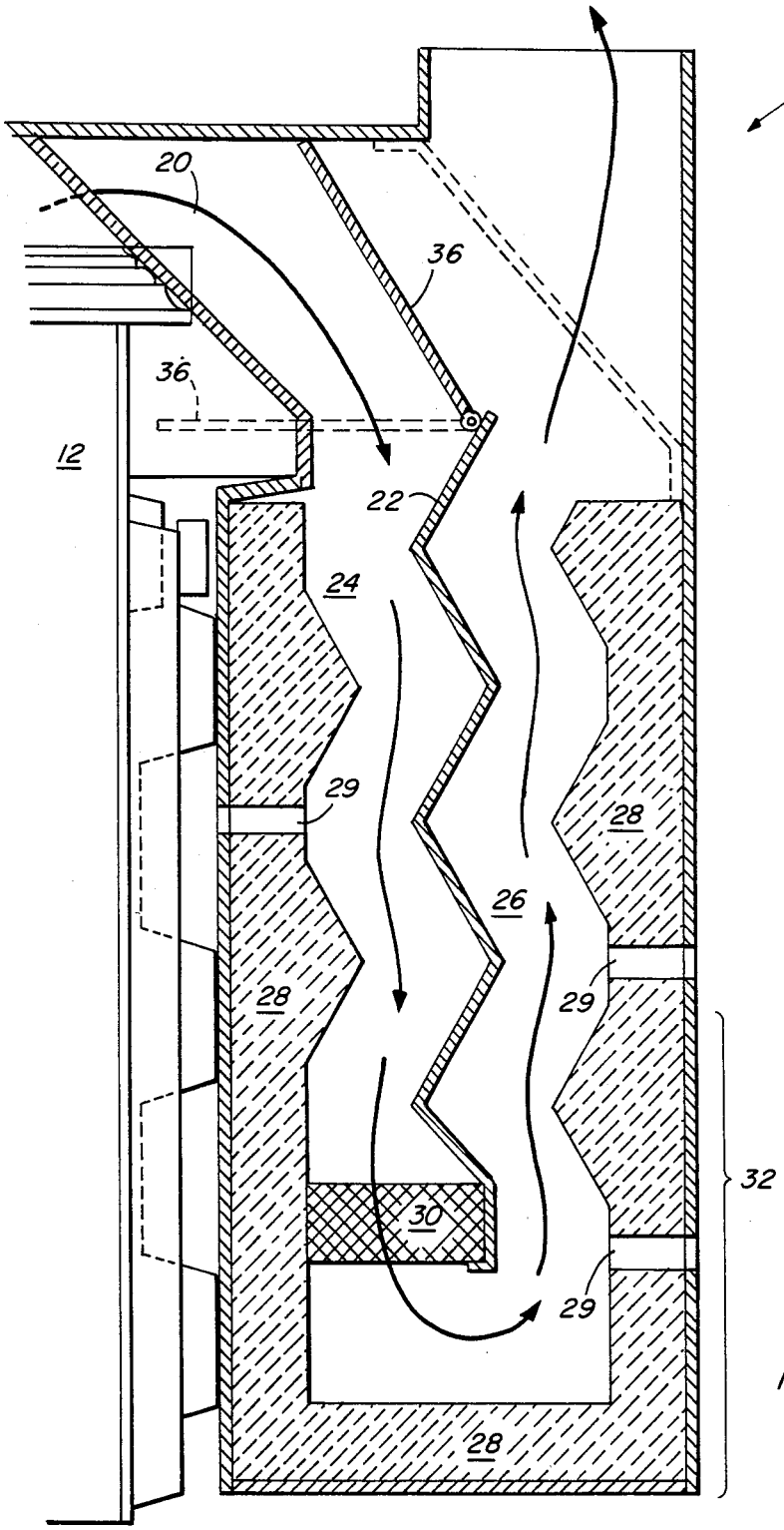
FIG. 2 is a cross-sectional view of the retrofit apparatus disclosed herein.

Still referring to FIG. 2, a damper 36 is provided which is integral with the retrofit apparatus 10 and which directs gases down through the passageway 24 when it is in the position illustrated in FIG. 2 and directly through the flue collar 34 when it is lowered into the position shown in phantom. The lowered position is utilized during loading of wood into the wood stove 12 or during start-up.

The above-described retrofit apparatus 10 is designed for clean operation in the heat output range of from 20,000–50,000 BTU's per hour or approximately 4–10 lbs. of wood per hour. Within this range, there should be a significant reduction in smoke and creosote being emitted from the flue. The combination of the refractory-lined secondary combustion chamber and catalytic igniter results in continued secondary combustion even if ideal conditions are not maintained. Thus, even if heat output drops, secondary combustion will continue without any operator attention. This characteristic is important because stoves are often operated for long periods of time without any attention. The insulated refractory-lined secondary chamber provides the gases with the residence time at the elevated temperatures necessary for more complete combustion.

It is thus seen that the objects of this invention have been achieved in that there has been described an exterior retrofit apparatus for attachment to a solid fuel heating appliance which substantially reduces the level of emissions and creosote as compared with a conventional woodburning stove. The apparatus is designed for easy attachment to a wood stove. The clean burning characteristics achieved with the retrofit unit disclosed herein come about as a result of preheating gases from the wood stove before they are ignited by a catalytic igniter in a refractory-lined secondary combustion chamber.

It is recognized that modifications and variations will occur to those skilled in the art and it is intended that all such modifications and variations be included within the appended claims. One such variation is the use of this system internally in a stove both as a retrofit and as a specifically designed wood stove. The combustion performance of this system used internally in a stove would meet or most likely exceed that of the external application due to the ability to conserve additional exhaust gas temperature before the catalyst.

What is claimed is:

1. An external retrofit combustion system for attachment to a woodburning heating apparatus comprising:

a firebox attached to said woodburning heating apparatus in communication with primary combustion flue gases from said heating apparatus, said firebox comprising refractory-lined walls including openings to allow secondary air to enter said firebox, said firebox further including a heat exchange barrier creating first and second passageways, the heat exchange barrier separating the primary combustion flue gases flowing in the first passageway from secondary combustion gases flowing in the second passageway; and a perforate catalytic igniter extending between said first and second passageways.

2. The apparatus of claim 1 wherein said heat exchange barrier is stainless steel.

3. The apparatus of claim 1 wherein said heat exchange barrier has a zig-zag configuration.

4. The apparatus of claim 1 wherein said refractory-lined walls have an undulating configuration.

5. The apparatus of claim 1 wherein refractory-lined walls are made of low density formed refractory material.

6. The apparatus of claim 1 wherein said catalytic igniter is approximately one inch thick.

7. The apparatus of claim 1 wherein said openings extend into both of said first and second passageways.

* * * * *